US007316085B1

(12) United States Patent
Freeman

(10) Patent No.: US 7,316,085 B1
(45) Date of Patent: Jan. 8, 2008

(54) SELF-STANDING DISPLAY DEVICE

(76) Inventor: Richard Stewart Freeman, 9532-B State Rd., Philadelphia, PA (US) 19114

( * ) Notice: Subject to any disclaimer, the term of this patent is extended or adjusted under 35 U.S.C. 154(b) by 70 days.

(21) Appl. No.: 10/816,491

(22) Filed: Apr. 1, 2004

Related U.S. Application Data

(60) Provisional application No. 60/439,576, filed on Apr. 2, 2003.

(51) Int. Cl.
*G09F 1/00* (2006.01)

(52) U.S. Cl. ..... 40/124.14; 40/124.16; 40/454; 281/38

(58) Field of Classification Search ..... 40/124.09, 40/124.14, 124.16, 124.18, 539, 454, 124.07, 40/124.01, 124; 283/56, 63.1; 281/38
See application file for complete search history.

(56) References Cited

U.S. PATENT DOCUMENTS 3,129,524 A * 4/1964 Hayslett ..... 40/750
3,159,329 A * 12/1964 Hiersteiner ..... 229/68.1
5,000,543 A * 3/1991 Curtin ..... 359/474
5,513,914 A * 5/1996 Faber ..... 383/10
5,626,551 A * 5/1997 Kearns et al. ..... 493/231
5,638,953 A * 6/1997 House ..... 206/308.1
5,822,897 A * 10/1998 Ertzan ..... 40/124.09
6,449,891 B1 * 9/2002 Miska ..... 40/789

* cited by examiner

*Primary Examiner*—Gary C. Hoge
(74) *Attorney, Agent, or Firm*—LaMorte & Associates

(57) ABSTRACT

A self-standing display device for providing a viewer with a printed image which can be easily removed from any print medium such as a magazine or book, simply folded and placed on self-standing long term display. The self-standing display may have support panels with a straight or flat base in which case it forms a stationery display or it may have side support panels with a curved bottom edge in which case it forms a display which can be rocked back and forth to enhance the display of animated or other specialized images.

8 Claims, 17 Drawing Sheets

Figure # 1
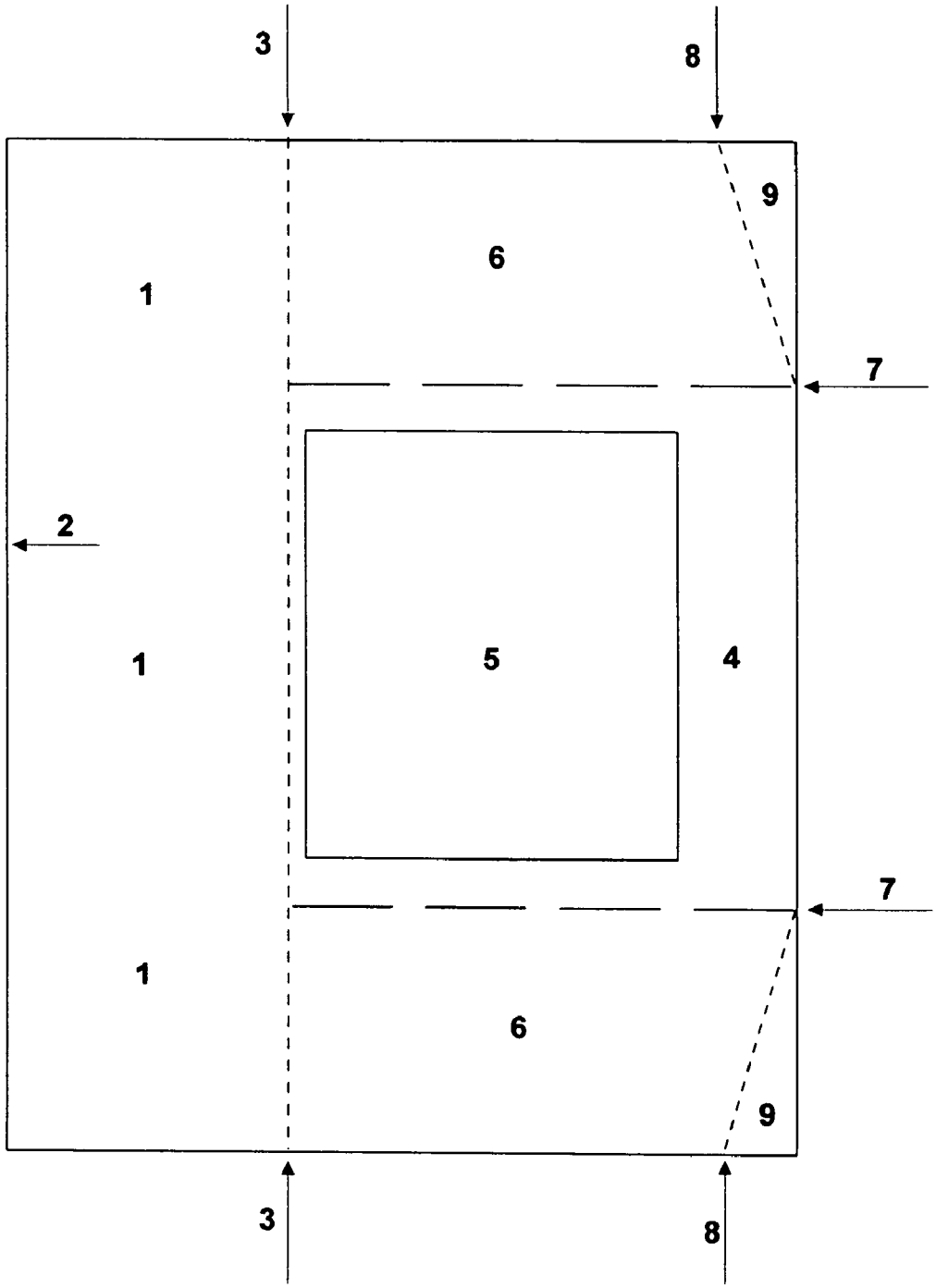

Figure # 2
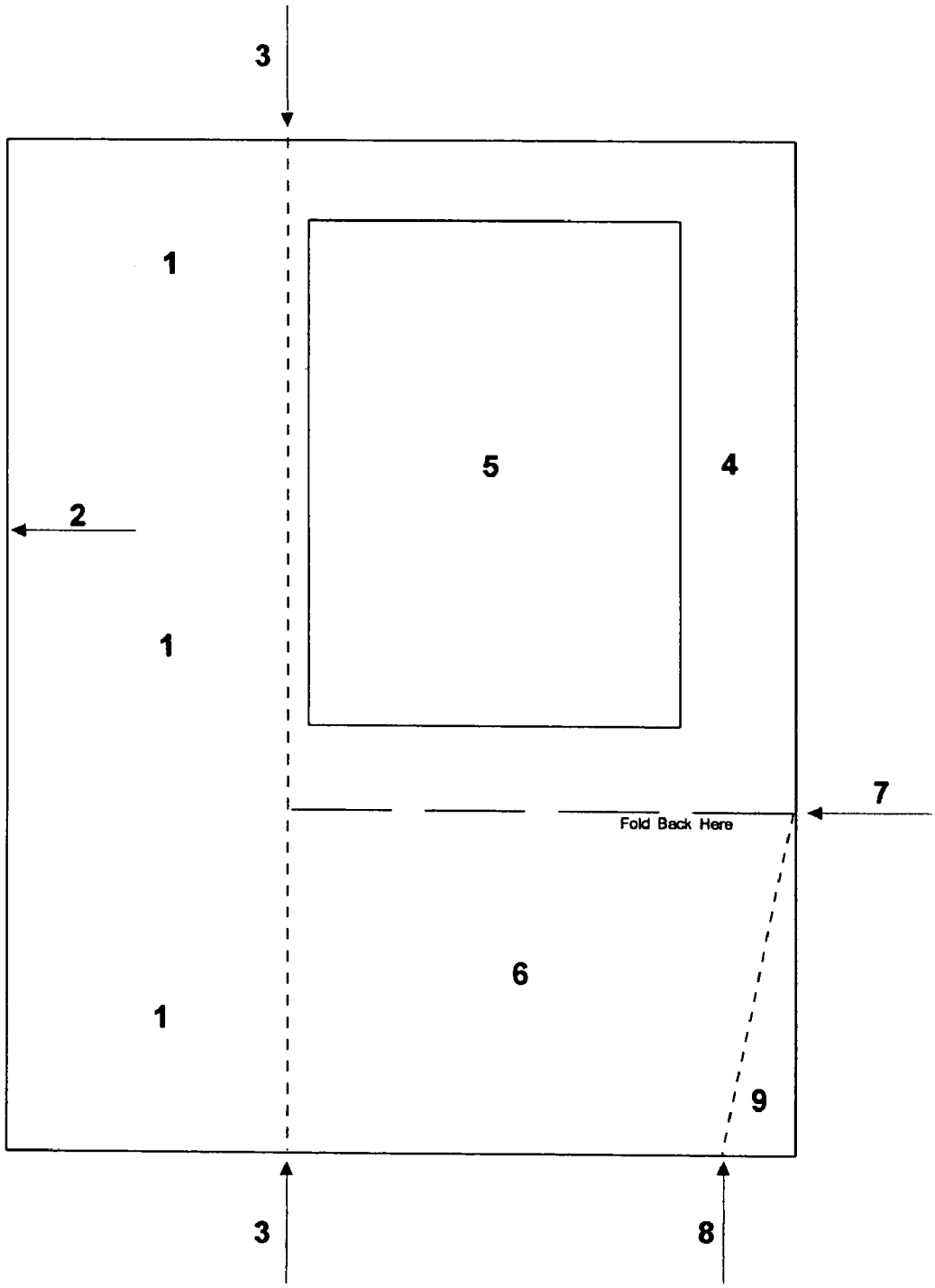

Figure # 3
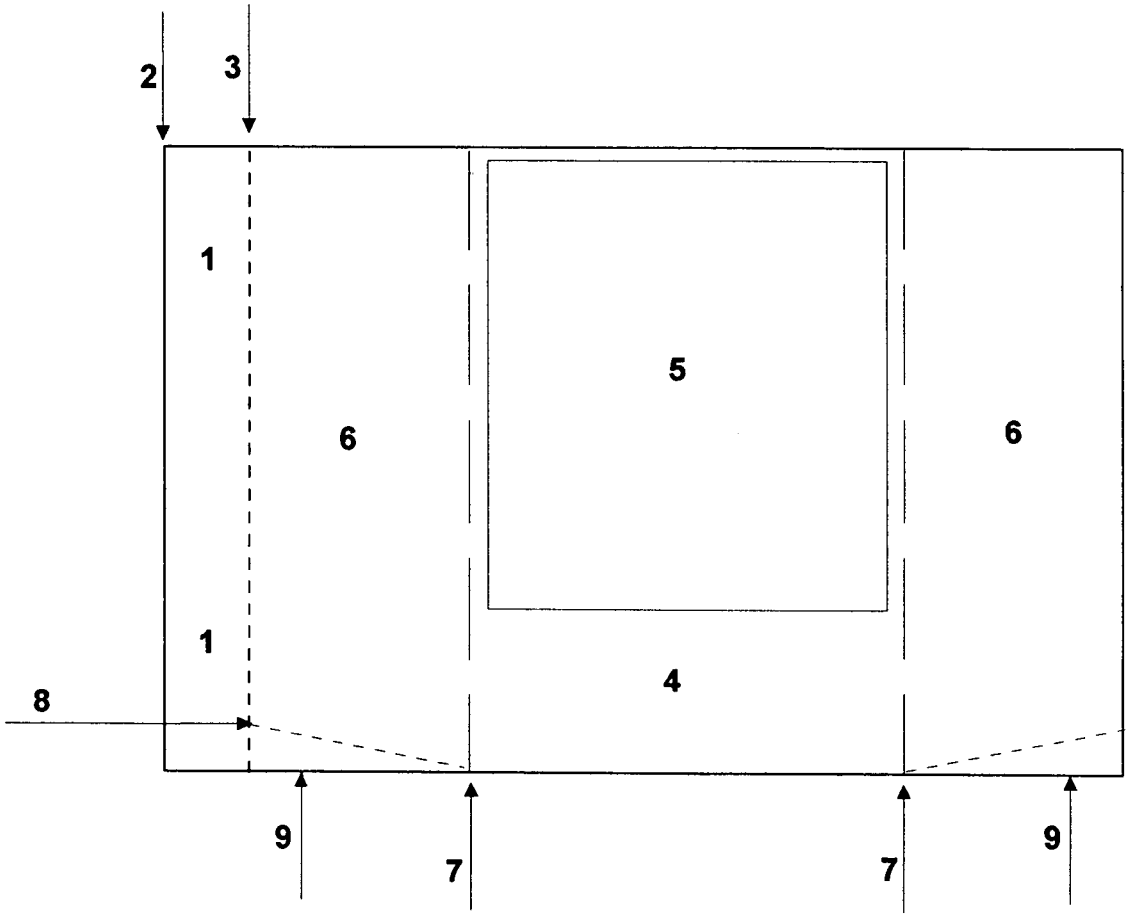

Figure # 4
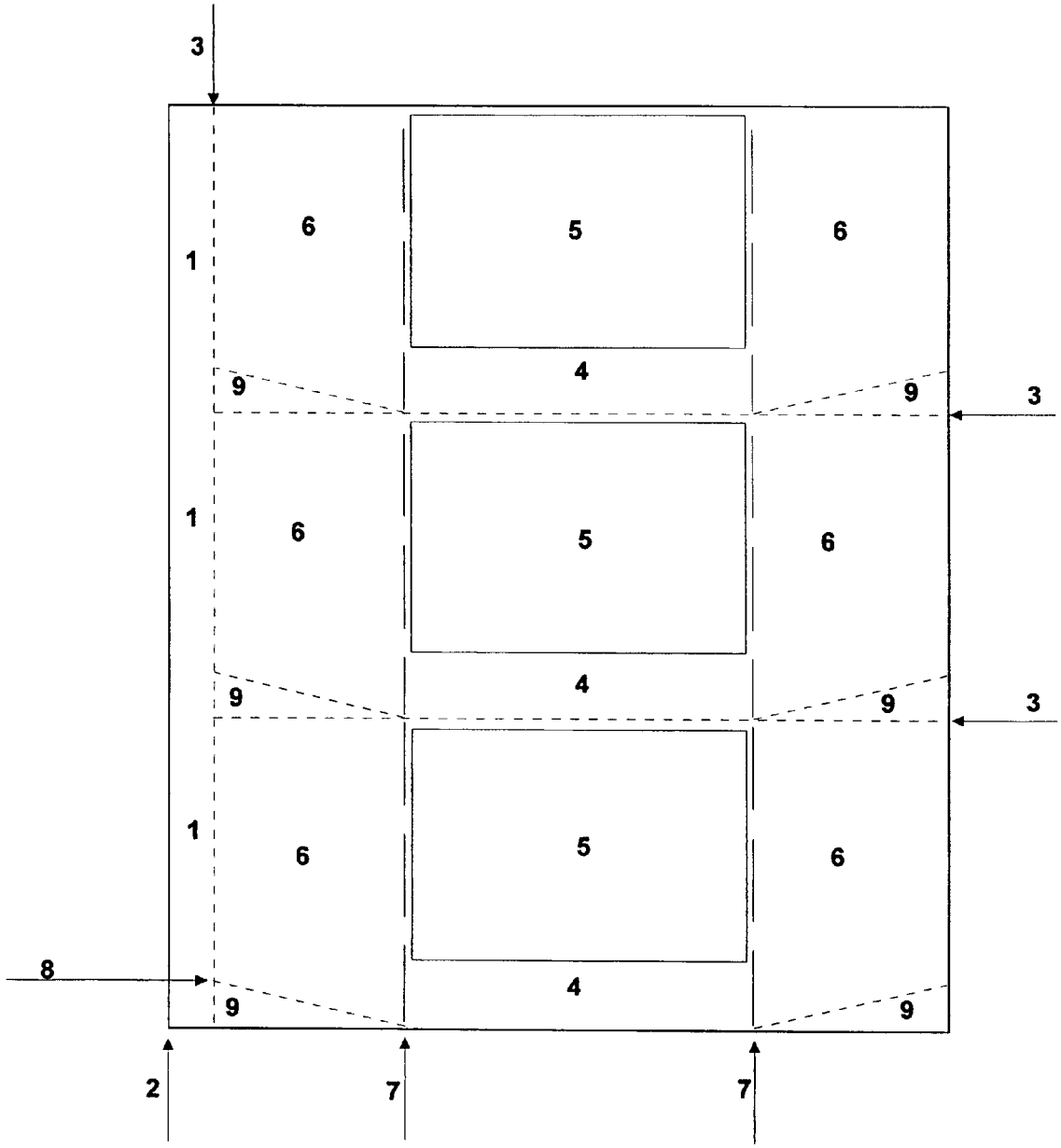

Figure # 5
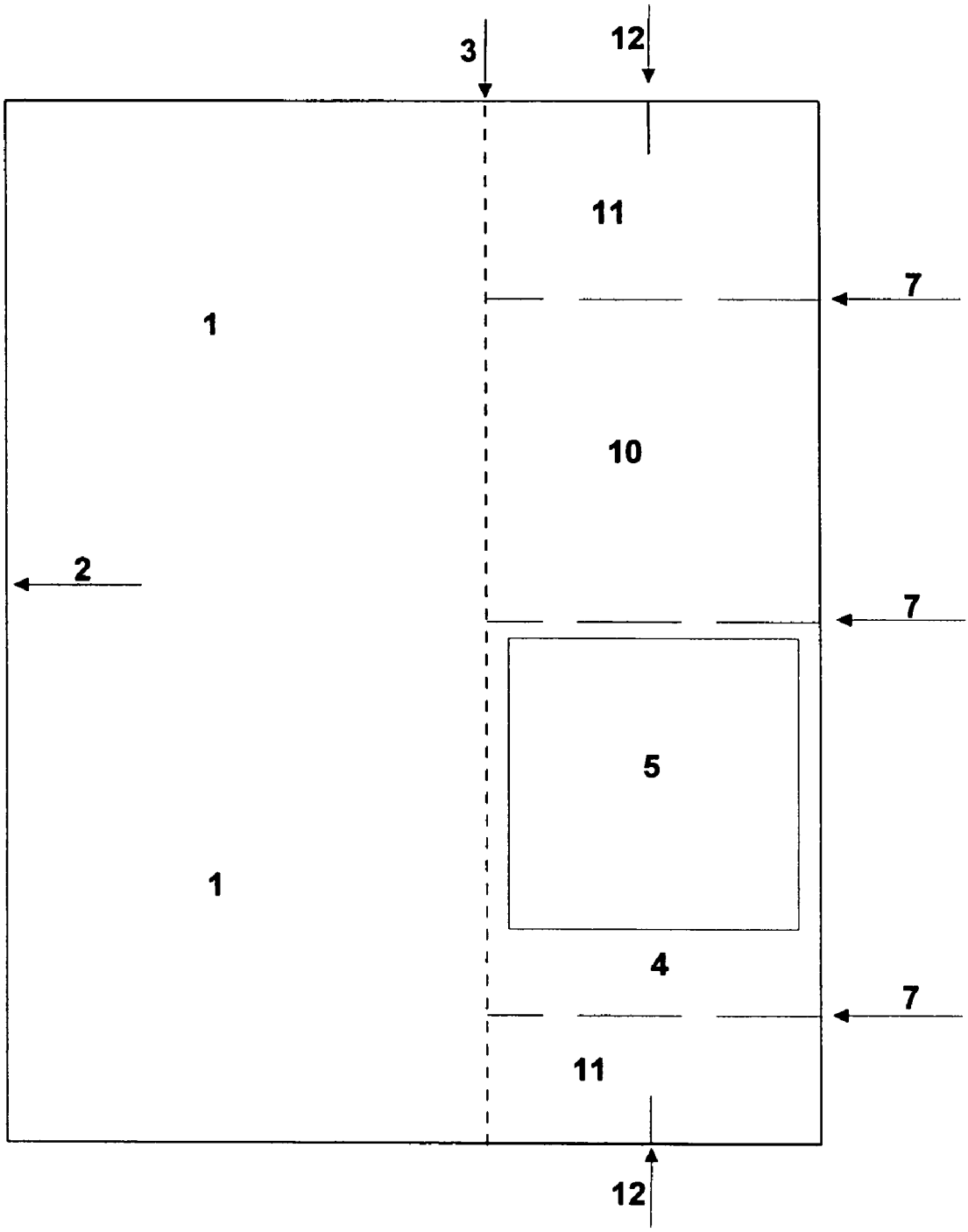

Figure # 6
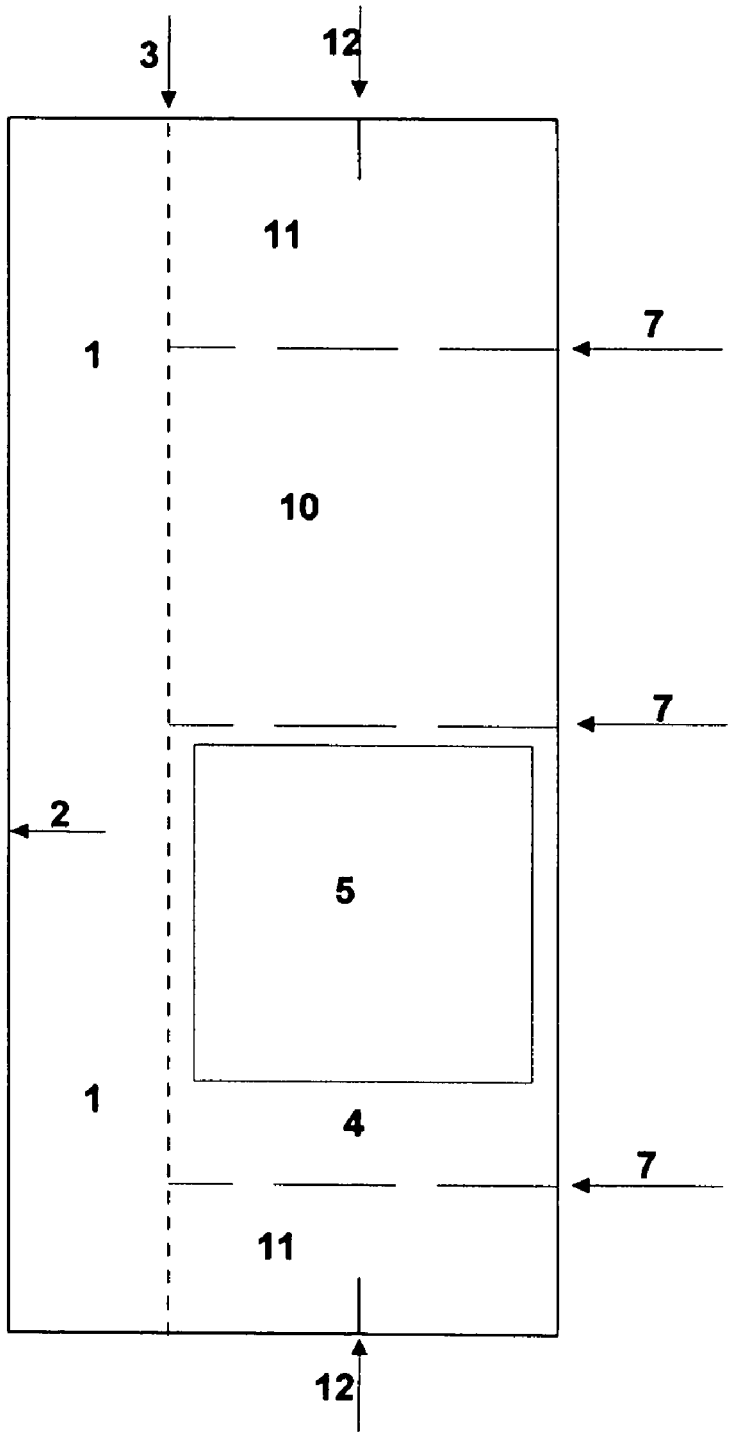

Figure # 7
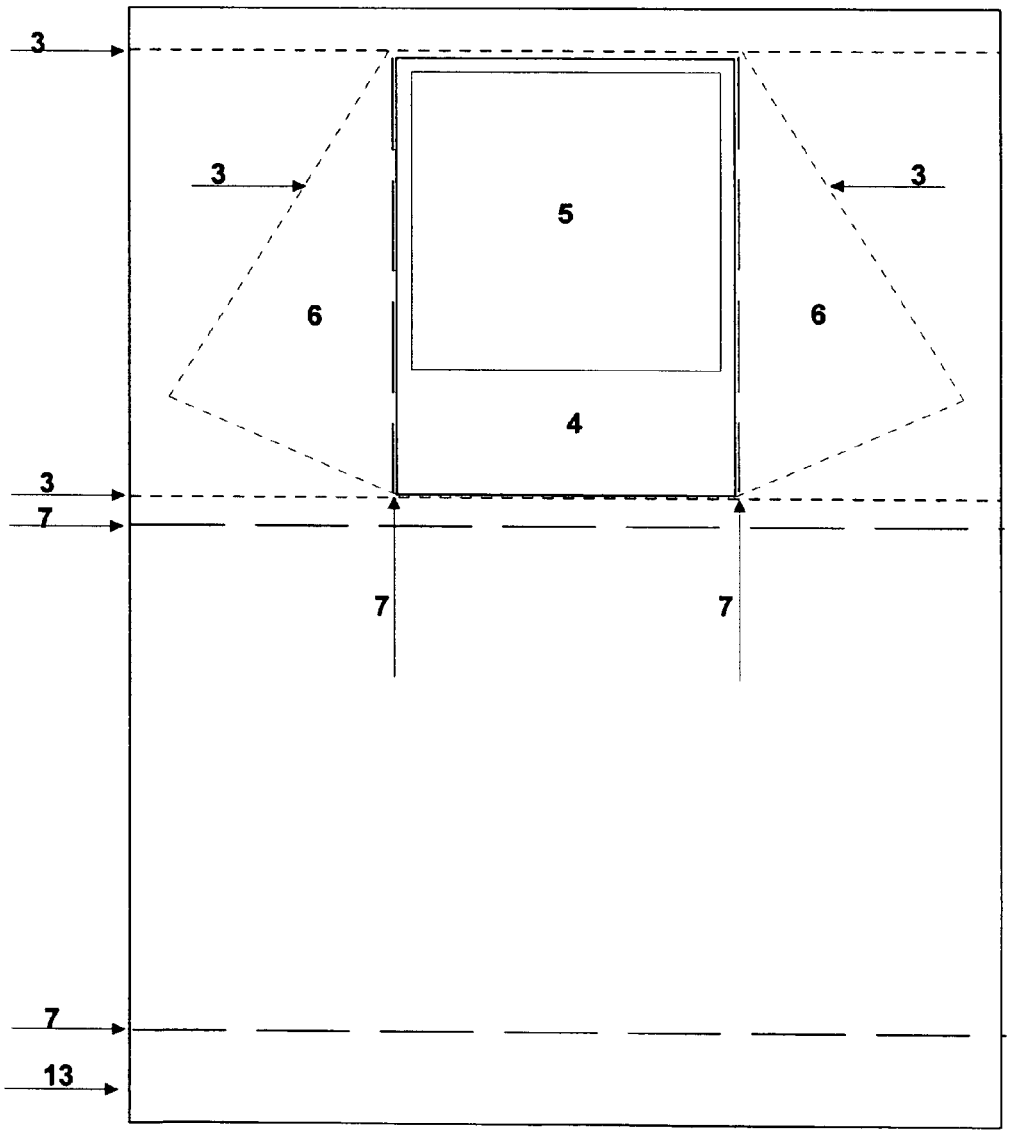

Figure # 8
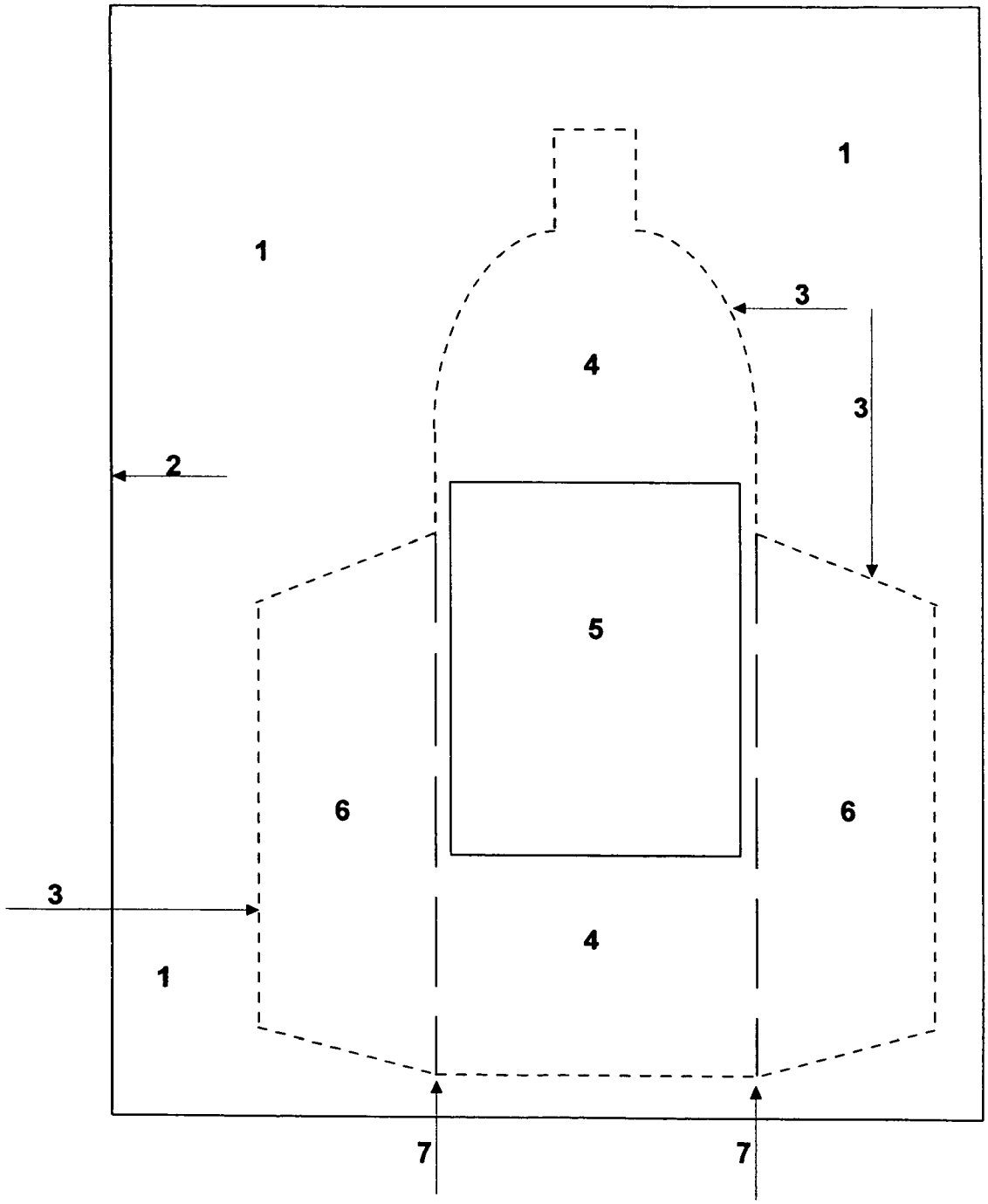

Figure # 9
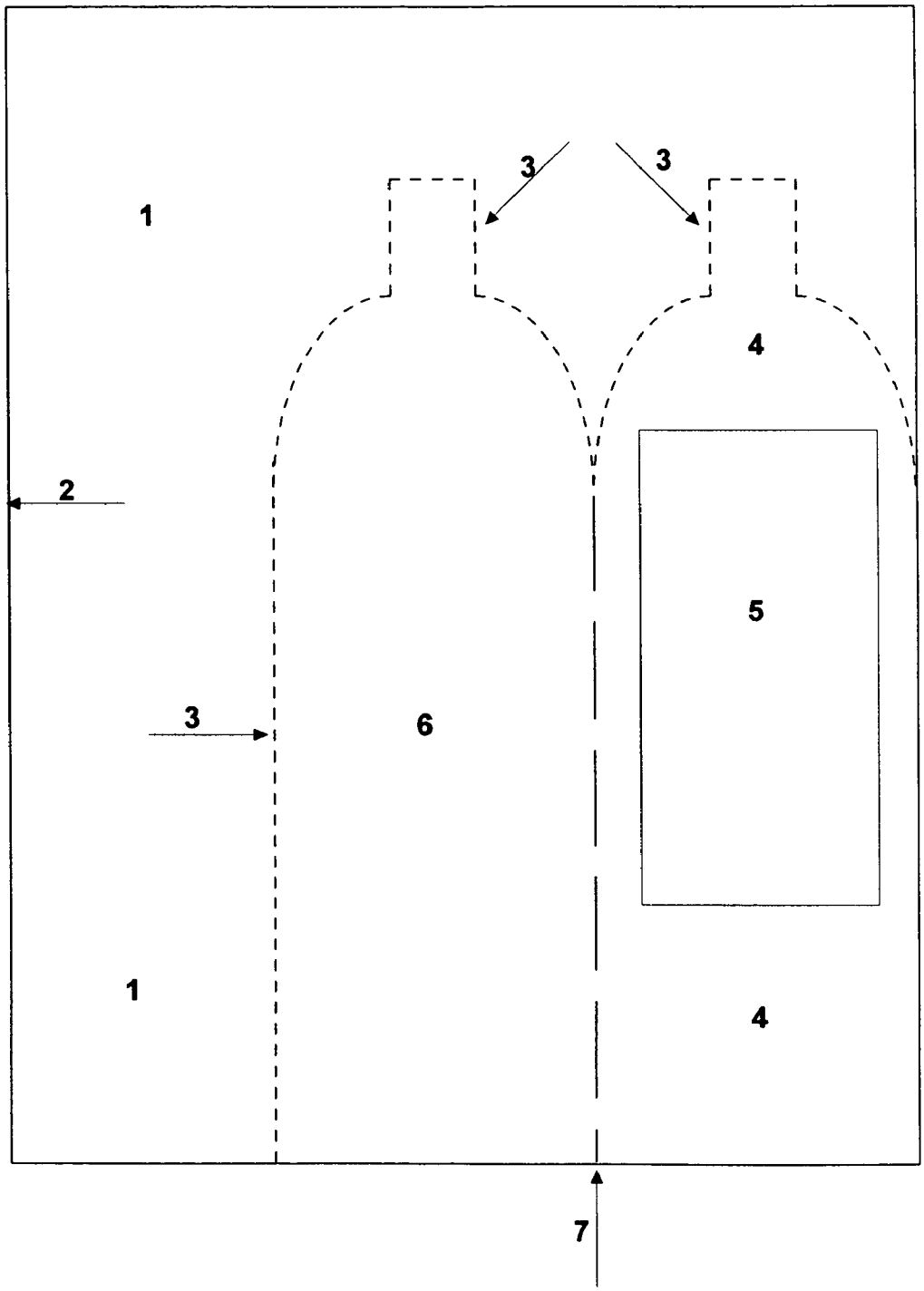

Figure # 10
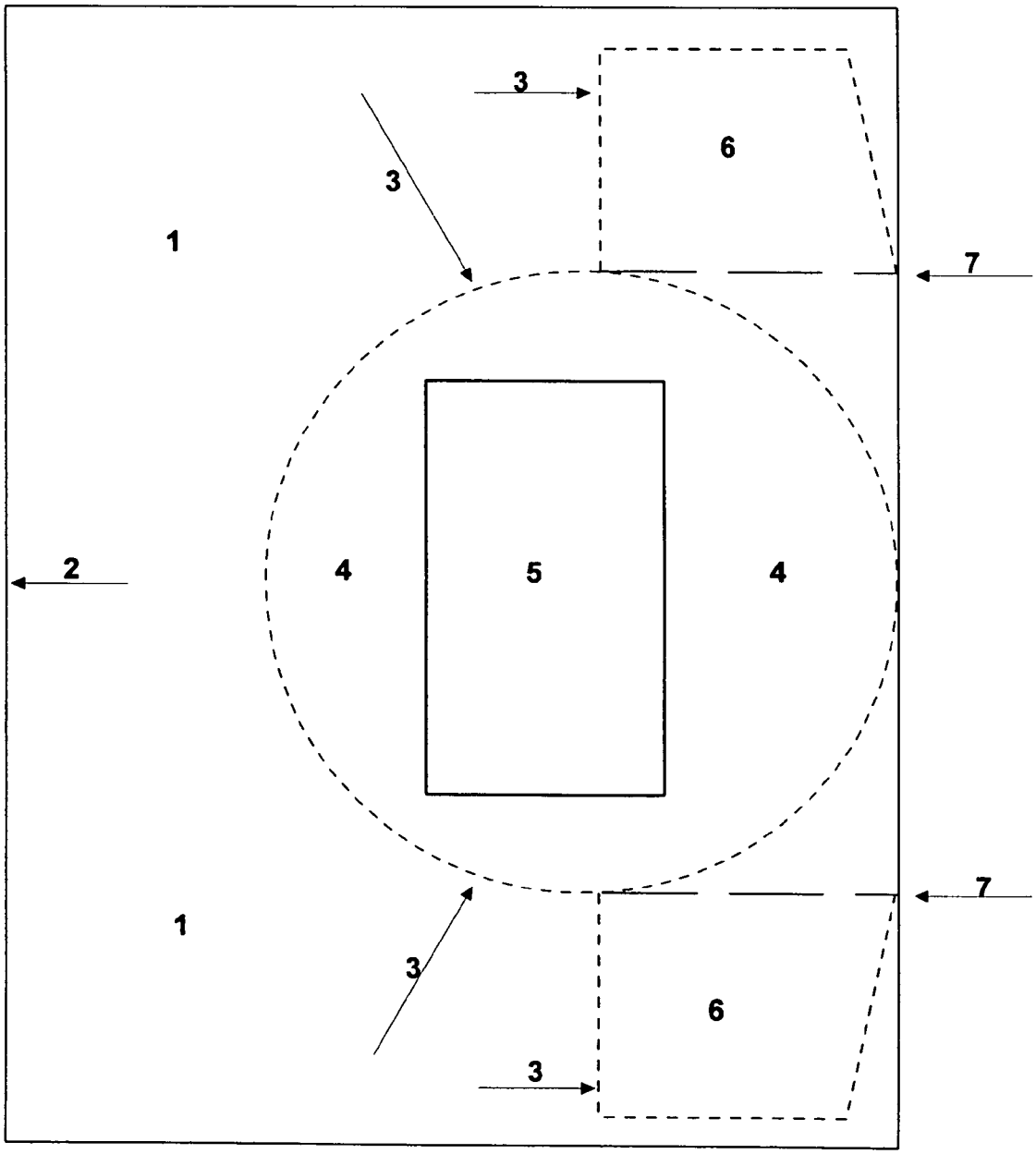

Figure #11
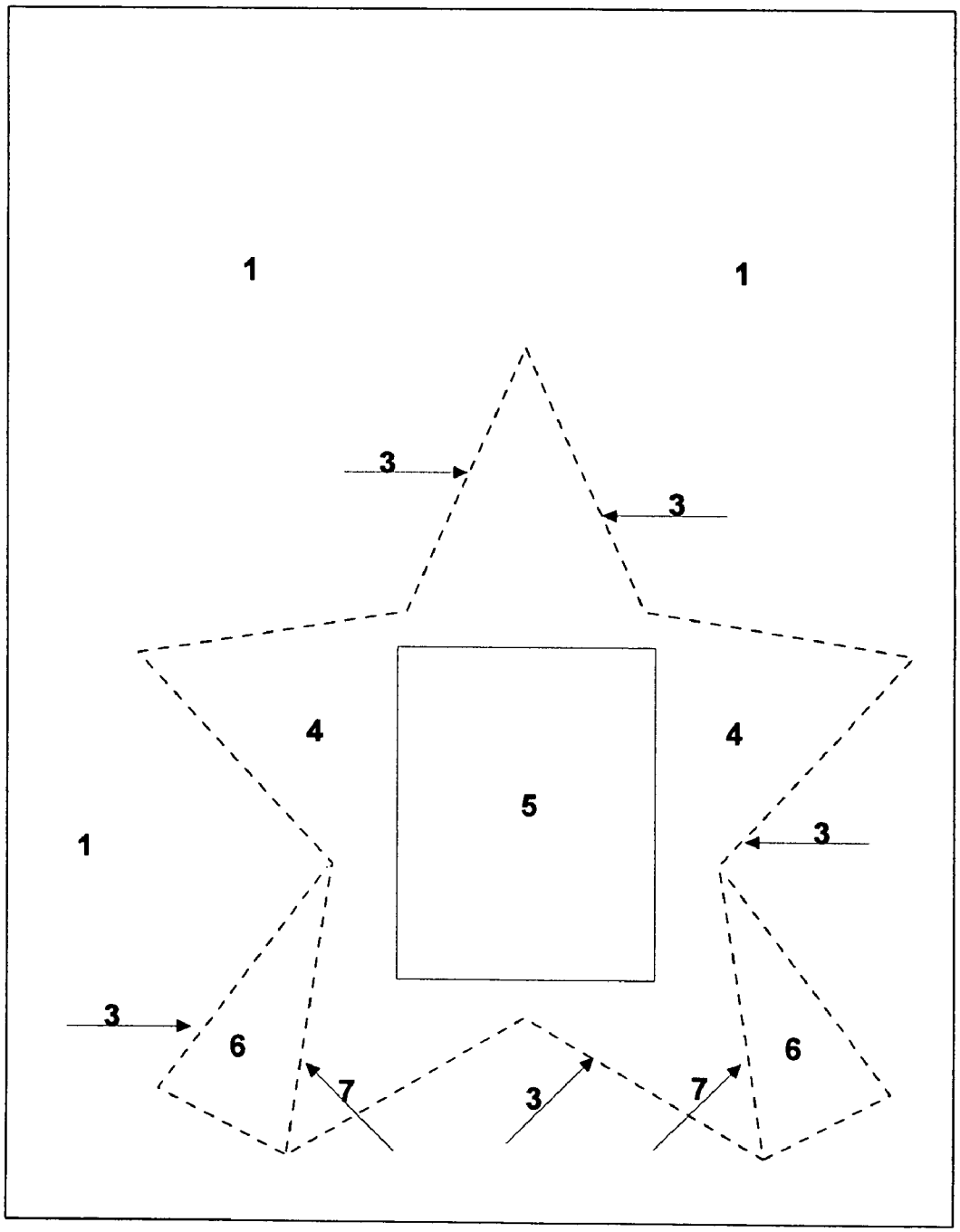

Figure #12
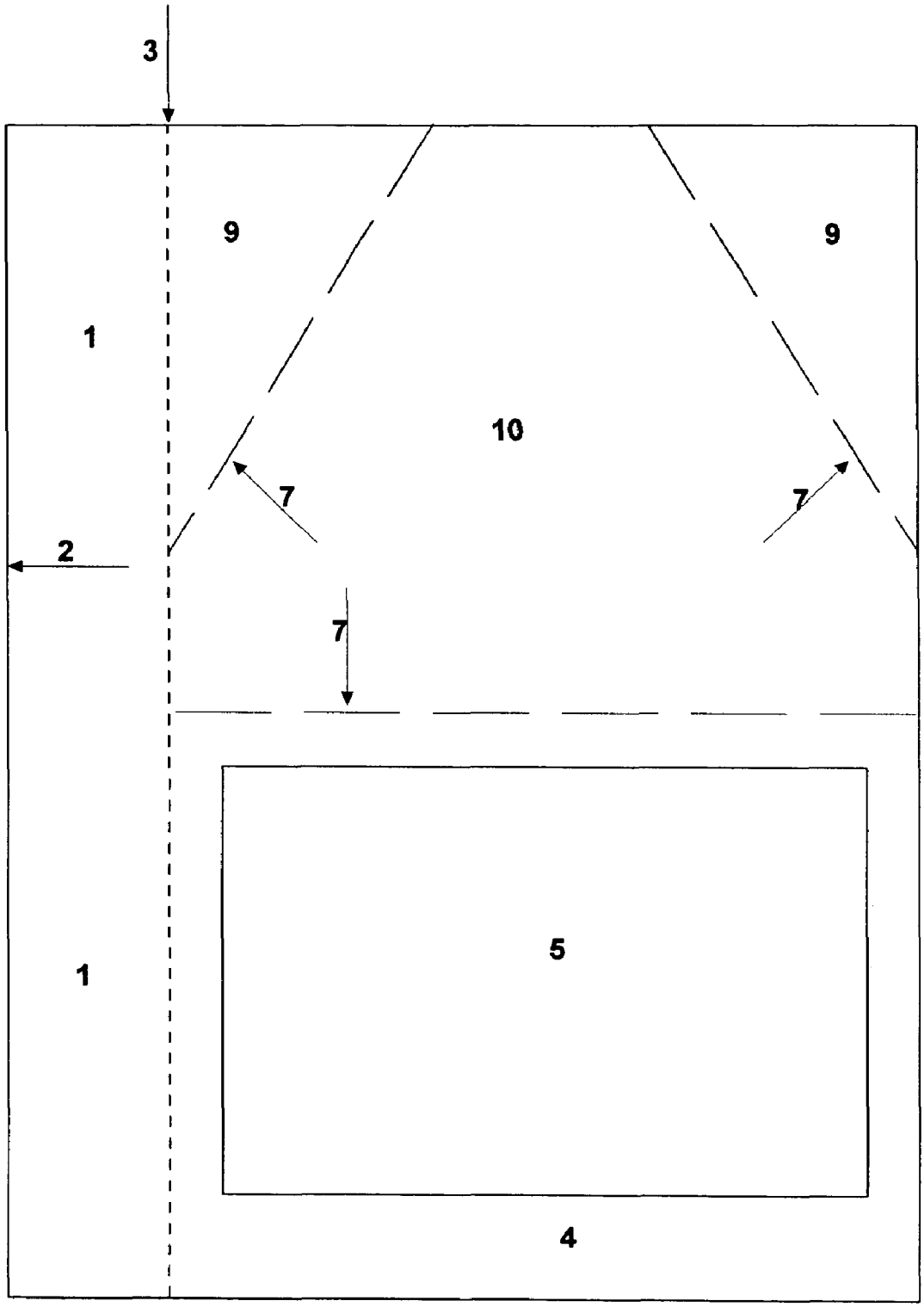

Figure # 13
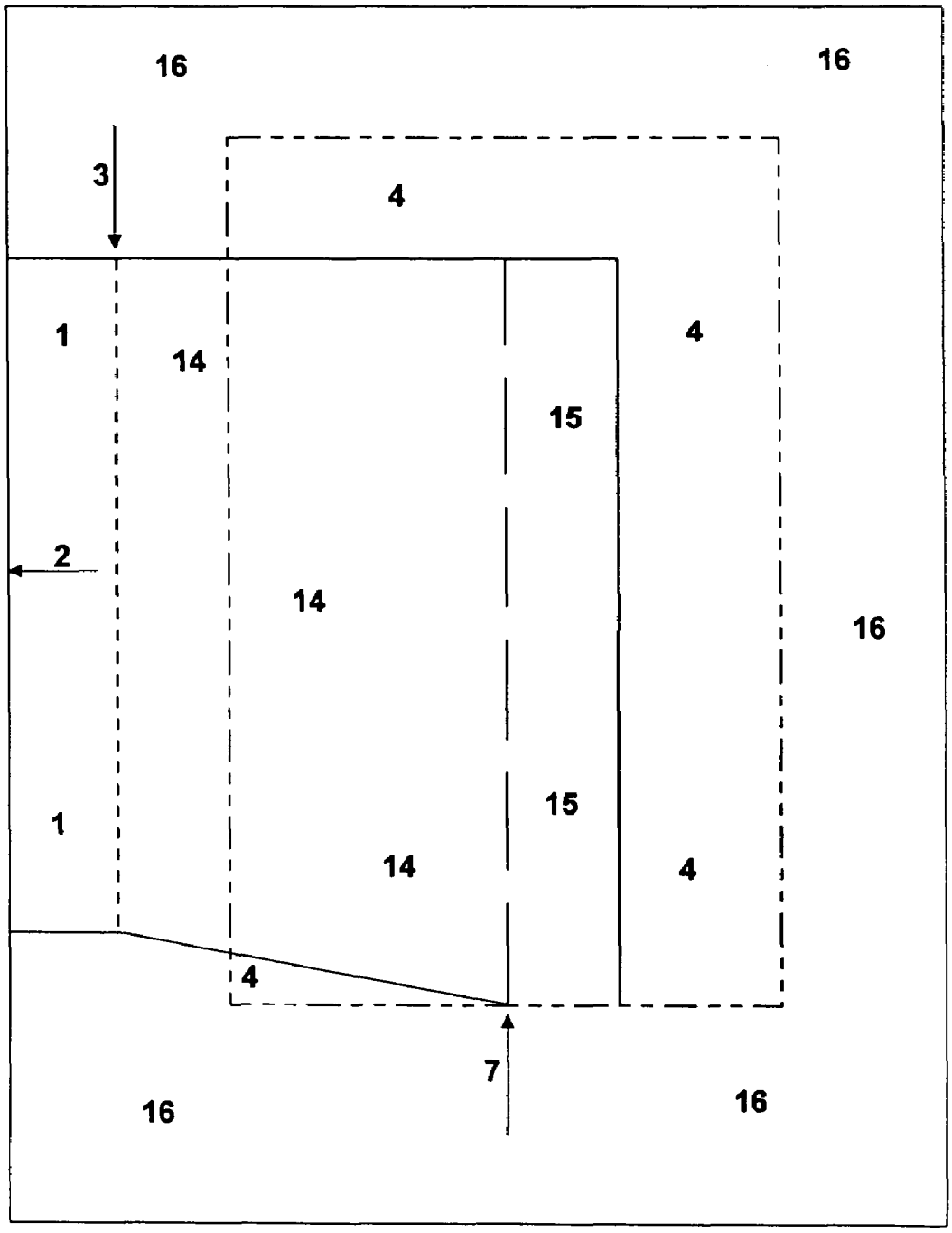

Figure #14
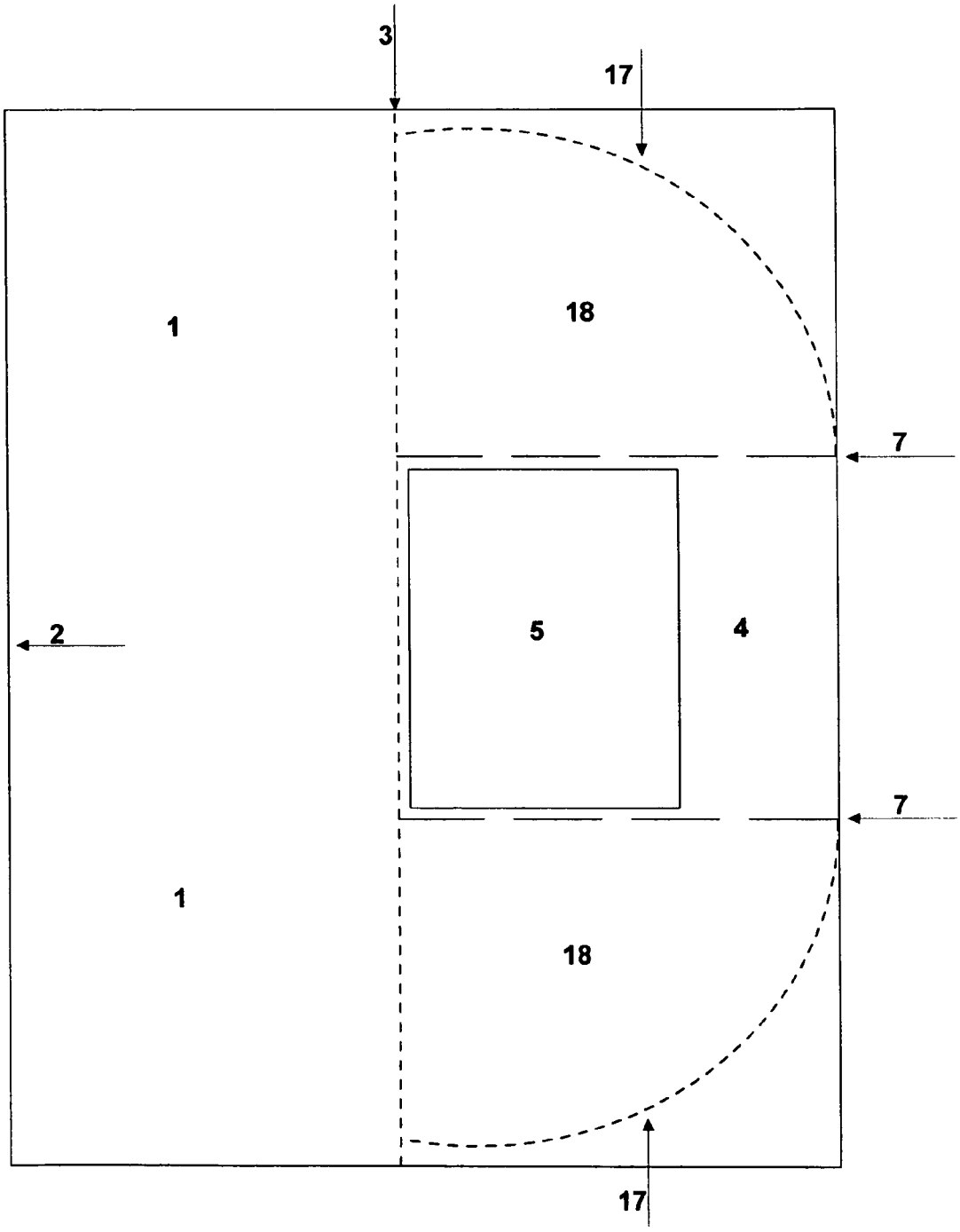

Figure #15
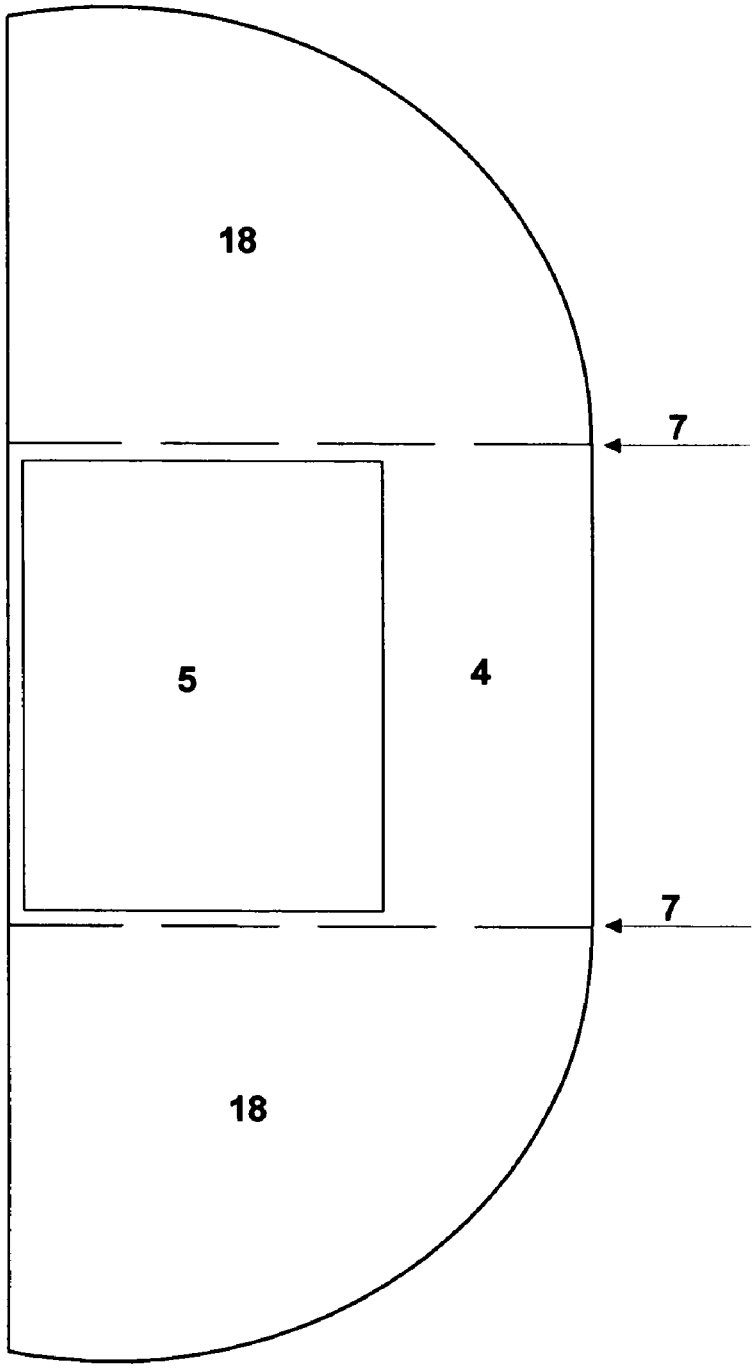

Figure #16
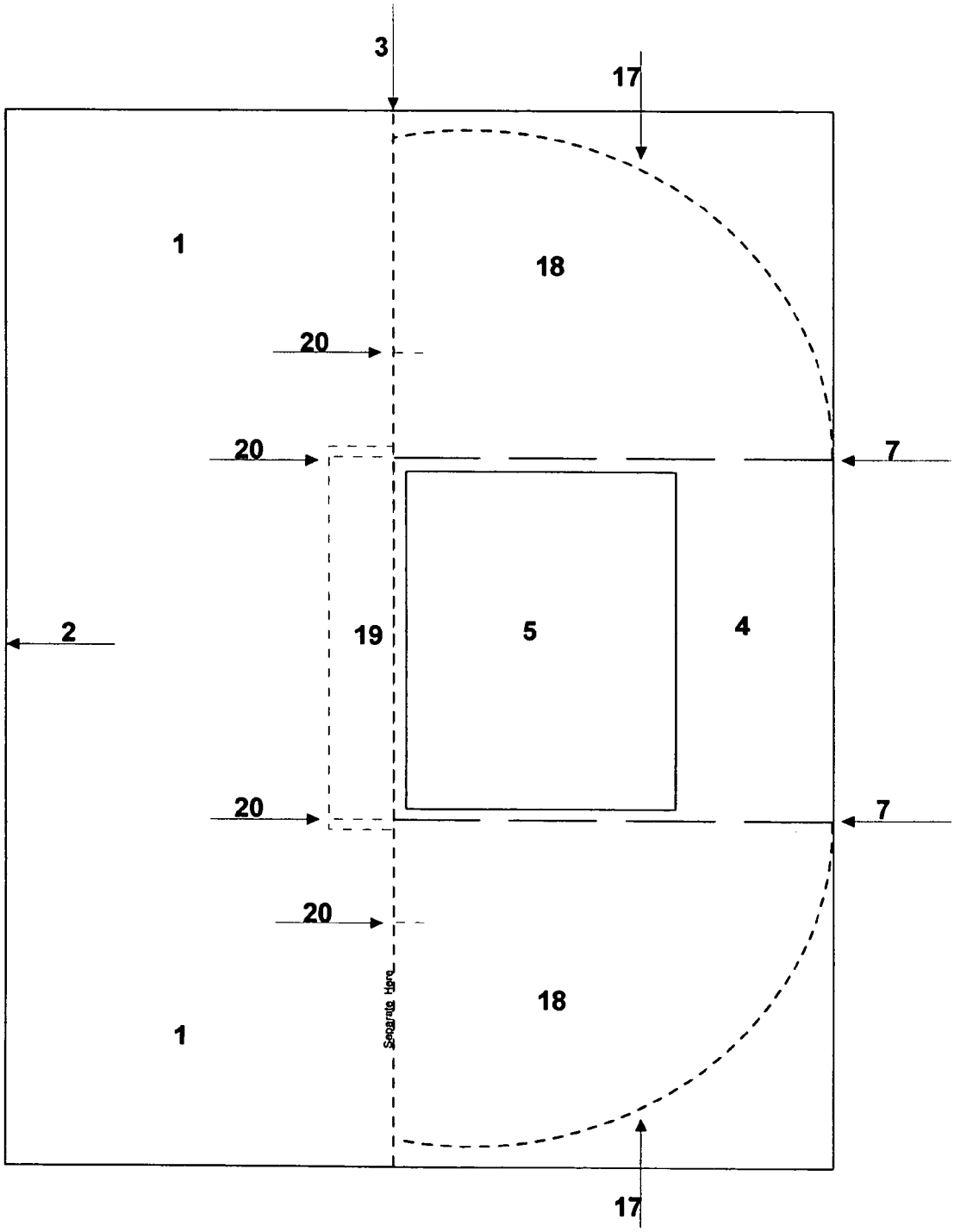

Figure #17
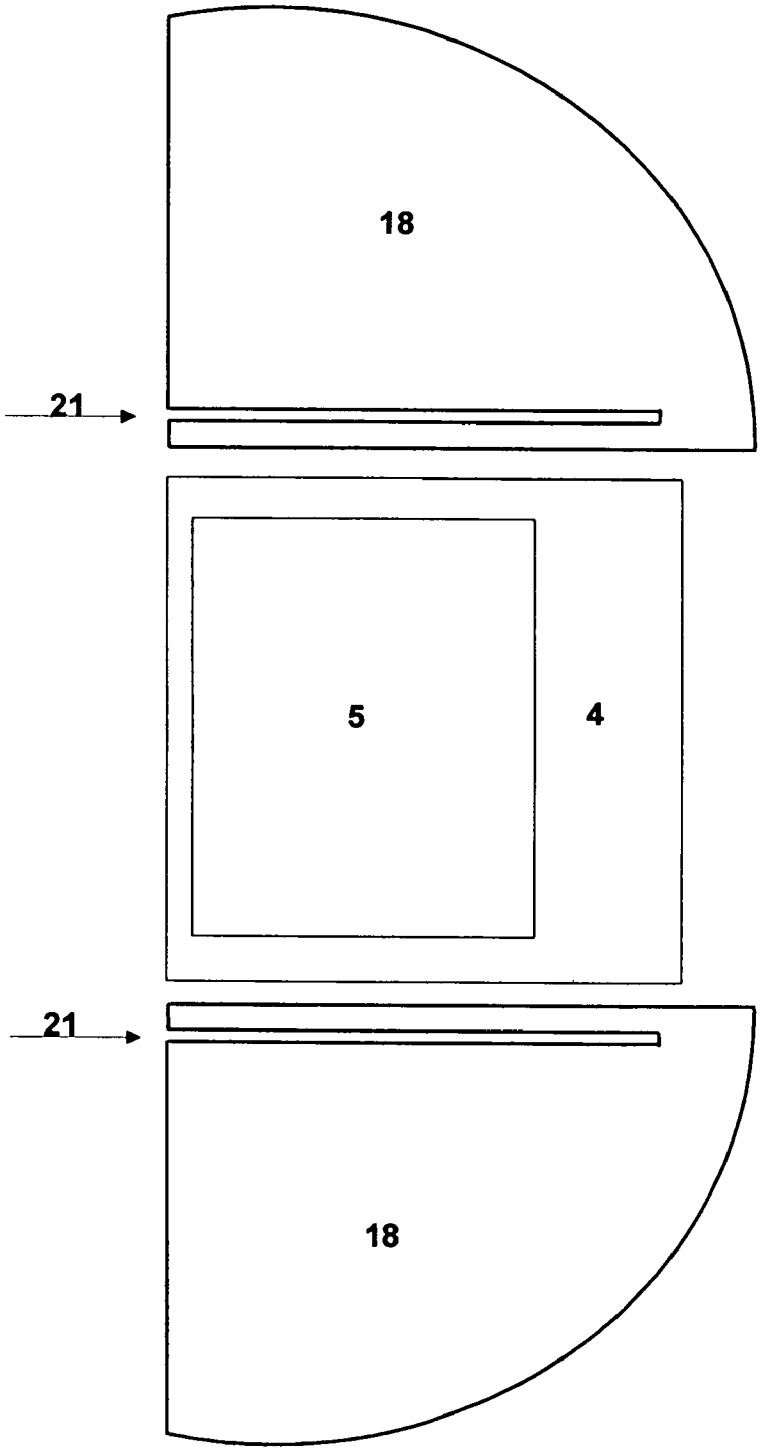

SELF-STANDING DISPLAY DEVICE

RELATED APPLICATIONS

This application claims the priority of Provisional Patent Application No. 60/439,576, entitled Self-Standing Display Device, which was filed on Apr. 2, 2003.

BACKGROUND OF THE INVENTION

1. Field of the Invention

The present invention relates generally to printed images and more specifically it relates to a self-standing display device for providing a viewer with a printed image which can be easily removed from any print medium such as a magazine or book, simply folded and placed on self-standing long term display. The self-standing display may have support panels with a straight or flat base in which case it forms a stationery display or it may have side support panels with a curved bottom edge in which case it forms a display which can be rocked back and forth to enhance the display of animated or other specialized images. In its application to advertising it gives the advertiser the opportunity to multiply the power and effect of its printed advertisement by providing a viewer with an advertisement that can be easily removed from the print medium, simply folded and placed on self-standing, long-term display. This provides for long-term, continuous viewing of the advertiser's message, rather than the limited viewing that it gets in the traditional print format. Another aspect of the invention is its application as retail merchandise to be used in books and other types of retail merchandise which may benefit by the specialized designs of the self-standing display. Another aspect is its application as retail merchandise in which it is not a part of a publication from which it must be detached, such as a greeting card or specialized, collectable image with a self-contained, free-standing easel. In this application it may be packaged and sold individually, pre-cut to it's final shape or designed to be detached from a discardable, extended panel used for marketing graphics and/or display purposes and, in some cases, with the support panels folded behind the front image display for easiest insertion in retail packaging.

2. Description of the Prior Art

It can be appreciated that printed images have been in use for years. Typically, printed images are comprised of, in the advertising field, all standard printed marketing, advertising and promotional materials and literature including but not limited to magazine ads, specialized bound-in inserts, free standing inserts, direct mail inserts, self-mailers and promotional hand out materials commonly found or used in magazines, catalogues, brochures, newspapers, comic books and direct mailers as well as trade-show promotional giveaways. Also in the field of mass market premium and incentive giveaways such as are commonly found in the fast food industry. And in the field of retail merchandise, all areas of printed book-type products as well as stand alone novelty and/or collectible display merchandise and other products such as greeting cards and desk or table display items.

The main problem with conventional printed images are, in advertising use, they capture the viewer's attention for a very limited amount of time, if at all. Due to the sheer volume of advertising messages bombarding consumers on a daily basis, most print advertisements are either overlooked completely or given a quick glance and then passed over. This limited viewing exposure severely limits and greatly reduces the potential impact of the advertising message. In retail, the printed book-type products do not give the consumer a way to easily create a self-standing display and in the collectible area, the materials that most collectibles are created from are too-expensive to meet certain mass-market and other lower price point distribution channel needs. Another problem with conventional printed images are they do not engage the viewer on an interactive level and do not provide a method to entice the viewer to keep the advertising image/message. The impact of an advertisement that is simply viewed is miniscule compared to the impact of an advertisement that is handled and/or removed from its original medium by a viewer. Another problem with conventional printed images are there is no method or device provided to allow a consumer to be able to easily create a simple self-standing display and no method or device is provided for long-term viewing. Most advertisements which have been removed and kept are placed in a pile of papers or a drawer and then promptly forgotten, along with the advertiser's message.

While these devices may be suitable for the particular purpose to which they address, they are not as suitable for providing a viewer with a printed image which can be easily removed from any print medium such as a magazine or book, simply folded and placed on self-standing long term display. The self-standing display may have support panels with a straight or flat base in which case it forms a stationery display or it may have side support panels with a curved bottom edge in which case it forms a display which can be rocked back and forth to enhance the display of animated or other specialized images. In its application to advertising it gives the advertiser the opportunity to multiply the power and effect of its printed advertisement by providing a viewer with an advertisement that can be easily removed from the print medium, simply folded and placed on self-standing long term display. This provides for long-term continuous viewing of the advertiser's message, rather than the limited viewing that it gets in the traditional print format. Another aspect of the invention is its application as retail merchandise to be used in books and other types of retail merchandise which may benefit by the specialized designs of the self-standing display. Another aspect is its application as retail merchandise in which it is not a part of a publication from which it must be detached, such as a greeting card or specialized, collectable image with a self-contained, free-standing easel. In this application it may be packaged and sold individually, pre-cut to it's final shape or designed to be detached from a discardable, extended panel used for marketing graphics and/or display purposes and, in some cases, with the support panels folded behind the front image display for easiest insertion in retail packaging. The main problem with conventional printed images are in advertising, they capture the viewer's attention for a very limited amount of time, if at all. Due to the sheer volume of advertising messages bombarding consumers on a daily basis, most print advertisements are either overlooked completely or given a quick glance and then passed over. This limited viewing exposure severely limits and greatly reduces the potential impact of the advertising message. In retail, the printed book-type products do not give the consumer a way to easily create a self-standing display and in the collectible area, the materials that most collectibles are created from are too-expensive to meet certain mass-market and other lower price point distribution channel needs. Another problem is they do not engage the viewer on an interactive level and do not provide a method to entice the viewer to keep the advertising image/message. The impact of an advertisement that is simply viewed is miniscule compared to the impact of an advertisement that is handled and/or removed from its original medium by a viewer. Also, another problem is there is no method or device provided to allow a consumer to be able to easily create a simple self-standing display and no method or device is provided for long-term viewing. Most advertisements which have been removed and kept are placed in a pile of papers or a drawer and then promptly forgotten, along with the advertiser's message.

In these respects, the self-standing display device according to the present invention substantially departs from the conventional concepts and designs of the prior art, and in so doing provides an apparatus primarily developed for the purpose of providing a viewer with a printed image which can be easily removed from any print medium such as a magazine or book, simply folded and placed on self-standing long term display. The self-standing display may have support panels with a straight or flat base in which case it forms a stationery display or it may have side support panels with a curved bottom edge in which case it forms a display which can be rocked back and forth to enhance the display of animated or other specialized images. In its application to advertising it gives the advertiser the opportunity to multiply the power and effect of its printed advertisement by providing a viewer with an advertisement that can be easily removed from the print medium, simply folded and placed on self-standing long term display. This provides for long-term continuous viewing of the advertiser's message, rather than the limited viewing that it gets in the traditional print format. Another aspect of the invention is its application as retail merchandise to be used in books and other types of retail merchandise which may benefit by the specialized designs of the self-standing display. Another aspect is its application as retail merchandise in which it is not a part of a publication from which it must be detached, such as a greeting card or specialized, collectable image with a self-contained, free-standing easel. In this application it may be packaged and sold individually, pre-cut to it's final shape or designed to be detached from a discardable, extended panel used for marketing graphics and/or display purposes and, in some cases, with the support panels folded behind the front image display for easiest insertion in retail packaging.

SUMMARY OF THE INVENTION

In view of the foregoing disadvantages inherent in the known types of printed images now present in the prior art, the present invention provides a new self-standing display device construction wherein the same can be utilized for providing a viewer with a printed image which can be easily removed from any print medium such as a magazine or book, simply folded and placed on self-standing long term display. The self-standing display may have support panels with a straight or flat base in which case it forms a stationery display or it may have side support panels with a curved bottom edge in which case it forms a display which can be rocked back and forth to enhance the display of animated or other specialized images. In its application to advertising it gives the advertiser the opportunity to multiply the power and effect of its printed advertisement by providing a viewer with an advertisement that can be easily removed from the print medium, simply folded and placed on self-standing long term display. This provides for long-term continuous viewing of the advertiser's message, rather than the limited viewing that it gets in the traditional print format. Another aspect of the invention is its application as retail merchandise to be used in books and other types of retail merchandise which may benefit by the specialized designs of the self-standing display. Another aspect is its application as retail merchandise in which it is not a part of a publication from which it must be detached, such as a greeting card or specialized, collectable image with a self-contained, free-standing easel. In this application it may be packaged and sold individually, pre-cut to it's final shape or designed to be detached from a discardable, extended panel used for marketing graphics and/or display purposes and, in some cases, with the support panels folded behind the front image display for easiest insertion in retail packaging.

The general purpose of the present invention, which will be described subsequently in greater detail, is to provide a new self-standing display device that has many of the advantages of the printed images mentioned heretofore and many novel features that result in a new self-standing display device which is not anticipated, rendered obvious, suggested, or even implied by any of the prior art printed images, either alone or in any combination thereof.

To attain this, the present invention generally comprises a printed page with specially perforated tear lines and specially scored fold lines. A printed page which may vary in size and may consist of varying materials including but not limited to various paper stocks, various plastics or other appropriate materials and will have various designs of specially perforated tear lines and specially scored fold lines. One variation includes any form of separately produced image which may be glued or otherwise attached to the stand-up display section of the page.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a self-standing display device that will overcome the shortcomings of the prior art devices.

An object of the present invention is to provide a self-standing display device for providing a viewer with a printed image which can be easily removed from any print medium such as a magazine or book, simply folded and placed on self-standing long term display. The self-standing display may have support panels with a straight or flat base in which case it forms a stationery display or it may have side support panels with a curved bottom edge in which case it forms a display which can be rocked back and forth to enhance the display of animated or other specialized images. In its application to advertising it gives the advertiser the opportunity to multiply the power and effect of its printed advertisement by providing a viewer with an advertisement that can be easily removed from the print medium, simply folded and placed on self-standing long term display. This provides for long-term continuous viewing of the advertiser's message, rather than the limited viewing that it gets in the traditional print format. Another aspect of the invention is its application as retail merchandise to be used in books and other types of retail merchandise which may benefit by the specialized designs of the self-standing display. Another aspect is its application as retail merchandise in which it is not a part of a publication from which it must be detached, such as a greeting card or specialized, collectable image with a self-contained, free-standing easel. In this application it may be packaged and sold individually, pre-cut to it's final shape or designed to be detached from a discardable, extended panel used for marketing graphics and/or display purposes and, in some cases, with the support panels folded behind the front image display for easiest insertion in retail packaging.

Another object is to provide a self-standing display device that provides a simple method of creating a self-standing display for long term viewing which has valuable applications in the fields of advertising and retail merchandise. In the field of advertising it greatly extends the amount of time that a print advertisement will appear before a viewer. Most advertisements are limited in impact due to the extremely short attention paid to them by viewers. By giving the viewer a compelling new advertising format which features a simple method to remove and keep the advertising image on display, the advertising message gains repeat viewings over an extended period of time, greatly enhancing the power of the message. In retail applications it adds a unique element of value wherein the product and packaging can be produced more cost-effectively as one complete unit providing a display header card which can be discarded by the purchaser while a specialized or collectable image with a self-contained, free-standing easel can be detached and separated from the packaging portion of the product and kept on display for long-term viewing.

Another object is to provide a self-standing display device that greatly improves the probability that a print advertisement will capture a viewer's attention. Due to sheer volume, most print advertisements are completely overlooked by viewers. Because the new format carries thicker paper, the viewer will automatically open to the advertisement when flipping through the magazine or other print medium. Although there is prior art which accomplishes this same benefit, because the new format is removable and capable of forming a self-standing display it solves the problem which the prior art has of being passed over, or removed and promptly discarded.

Another object is to provide a self-standing display device that creates powerful interactivity with a print advertisement. Most prior art (print advertisements) are simply glanced at by the viewer. The new format provides a compelling reason and a simple method which allows the viewer to interact with the advertisement by actually removing it from its original medium, folding it and putting it on display. This interactive handling of the advertisement greatly enhances the power of the advertising message.

Another object is to provide a self-standing display device that allows the advertiser to give the consumer something of perceived value that the consumer will keep on display. Although advertisers can give consumers coupons or discounts in a print advertisement, once that coupon is used it is quickly forgotten. The new format allows an advertiser to give the consumer a stand up easel which carries an image that the consumer will wish to keep on display. This creates the perceived value of a gift from the advertiser to the viewer.

Another object is to provide a self-standing display device that provides greater cost effectiveness to the advertiser based on the higher value and benefits derived from long term viewing by the advertiser's target audience which is achieved for the same cost of one standard advertisement which is passed over or discarded.

Another object is to provide a self-standing display device that creates a product and packaging combination which can be produced more cost-effectively as one complete unit providing a display header card which can be discarded by the purchaser while a specialized or collectable image with a self-contained, free-standing easel can be detached and separated from the packaging portion of the product and kept on display for long-term viewing. Additionally, the display header card portion of the device may have holes or hooks or other design characteristics which will allow it to be used to attach to, or hang from, a retail display case, shelf or hook.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 1 is a full page, single image display device with a front display panel and with 2 side panels.

FIG. 2 is a full page, single image display device with a front display panel and with 1 side panel.

FIG. 3 is a half page, single image display device with a front display panel and with 2 side panels.

FIG. 4 is a full page, multiple image display device, each with a front display panel and with 2 side panels.

FIG. 5 is a full page, single image display device designed as an A-frame type of structure with 2 bottom connecting panels or with no bottom connecting panels.

FIG. 6 is a half page, single image display device designed as an A-frame type of structure with 2 bottom connecting panels or with no bottom connecting panels.

FIG. 7 is a full page, single image display device with 2 side panels and designed to be used as a direct mail self-mailer.

FIG. 8 is a full page, single image display device with 2 side panels and designed to create a specific product or object shape in the self-standing display device.

FIG. 9 is a full page, single image display device with 1 side panel and designed to create a specific product or object shape in the self-standing display device.

FIG. 10 is a full page, single image display device with 2 side panels and designed to create a specific custom shape in the self-standing display device.

FIG. 11 is a full page, single image display device with 2 side panels and a front panel designed to create an irregular shape in the self-standing display device.

FIG. 12 is a full page, single image display device with a front display panel and with 1 top back-folding panel.

FIG. 13 is a partial page, single image display device with a front display panel and with 1 rear easel panel.

FIG. 14 is a full page, single image display device with a front display panel and with 2 curved edge side panels designed to create a front-to-back rocking action.

FIG. 15 is a pre-cut and free-standing, single image display device with a front display panel and with 2 curved edge side panels which is designed to be used as a free-standing insert or in packaging and requires no detachment from a bound page.

FIG. 16 is a full page, single image display device with 2 curved edge side panels and a separate cross-bar used to provide structural support.

FIG. 17 is a full page, single image display device with a separate front display panel and with 2 separate curved edge side panels which are joined with the front panel to create the self-standing display devise.

DESCRIPTION OF THE PREFERRED EMBODIMENT

Turning now descriptively to the drawings, in which similar reference characters denote similar elements throughout the several views, the attached figures illustrate a self-standing display device, which comprises a printed page with specially perforated tear lines and specially scored fold lines. A printed page which may vary in size and may consist of varying materials including but not limited to various paper stocks, various plastics or other appropriate materials and will have various designs of specially perforated tear lines and specially scored fold lines. One variation includes any form of separately produced image which may be glued or otherwise attached to the stand-up display part of the page.

Referring to FIG. 1, the drawing shows a printed page which may vary in size, may consist of various materials including but not limited to various paper stocks, plastics or other appropriate materials, may be of various designs and will have various structural elements within the design, including but not limited to, a binding attachment panel (1) which secures the printed page into the binding (2) of a publication or which, in the case of use as a retail product, may function as a packaging display header card, perforated detachment lines (3), scored fold lines (7), a front display panel (4) with an image display area (5), side support panels (6), and optional fold-under support panels (9) which can be folded on or removed from the perforation or score line (8). The printed page consists of a page of appropriate material that can be printed upon. This material includes but is not limited to paper of varying stocks and plastics of varying thickness. The printed page can be bound into a print medium such as a magazine or book, can be part of a mailer, can be a free-standing insert, or can be a stand alone retail product in its own packaging. The printed page consists of various structural elements as described above, the purpose of which is to form a self-standing device. Additionally the front display panel may include a specially designated image area for variations which involve the attachment of a separately printed image.

In one variation, the Printed Page is designed to be bound into a print publication and has a Binding Attachment Panel which is labeled "1" in FIGS. 1 thru 6, 8 thru 14 and 16 and is specifically designed for that purpose. In one variation a portion of the Printed Page is designed to be detachable along a Perforated Detachment Line labeled "3" in FIGS. 1 thru 14 and 16. In this variation, after detachment, the detached portion of the Printed Page is to be folded to form the self-standing display. The detached portion is folded along certain Score Lines which are labeled "7" in FIGS. 1 thru 16. In one variation the image is printed or mounted in the Image Display Area which is labeled "5" in FIGS. 1 thru 17 and which is located on the Front Display Panel which is labeled "4" in FIGS. 1 thru 17.

In one variation the detached portion of the Printed Page is to be folded in a certain manner to form a stand up display with supporting panels on the side or sides. The Side Support Panel(s) are labeled "6" in FIGS. 1 thru 4, 7 thru 11 and 14 thru 17. In one variation the detached portion of the Printed Page has Optional Fold-Under Support Panels which are labeled "9" in FIGS. 1 thru 4 with a multi-purpose Perforation or Score Line which are labeled "8" in FIGS. 1 thru 4.

In one variation the detached portion of the Printed Page is folded back and under forming rear and bottom support panels rather than side support panels. The Rear Support Panel is labeled "10" in FIGS. 5, 6 and 12 and the Bottom Support Panel is labeled "11" in FIGS. 5 and 6 and is stabilized by inserting one part into another through a Cut Line labeled "12" in FIGS. 5 and 6. In one variation the detached portion of the Printed Page forms a Rear Easel Support Panel labeled "14" in FIG. 13 with a Front Display Attachment Panel labeled "15" in FIG. 13 for the purpose of attaching the Rear Easel Support Panel to the Front Display Panel. In this variation the Self-Standing Display Device is not a part of a full insert page and is shown in FIG. 13 separately bound in and in front of the page behind it which is labeled "16".

In one variation, the Printed Page is detached and the detached portion has a secondary detachment line which is curved in order to form a rocking base. This Curved Perforated Detachment Line is labeled "17" in FIGS. 14 and 16 and forms Curved Bottom Edge Side Support Panels which are labeled "18" in FIGS. 14, 15, 16 and 17. In one variation as shown in FIG. 15, the entire area of the Printed Page is pre-cut and requires no detachment. It can have side panels with a straight bottom edge or curved bottom edge. The curved bottom edge style is illustrated in FIG. 15. In one variation the Printed Page is detached and the detached portion is stabilized with a Top Support Crossbar device labeled "19" in FIG. 16. The crossbar device and side panels have matching Mating Slits labeled "20" in FIG. 16 which allows the crossbar to attach to the side panels in a manner which holds them securely in place. In one variation, the Printed Page is pre-cut with pre-separated Front and Side Panes. The Side Panels are designed with long Mating Slits labeled "21" in FIG. 17 into which the Front Panel is inserted which then forms the complete structure of the stand-alone rocking display.

One variation includes any form of separately produced image which may be glued or otherwise attached to the stand-up display part of the page. The separately Printed Image will consist of a printed image which is glued or otherwise attached to the Image Area of the Front Display Panel. In one variation the separately Printed Image will be printed on lenticular plastic of varying thickness for the purpose of displaying 3D, animated or other forms of special effects image. In one variation the separately Printed Image may be a hologram printed on special holographic foil or other print medium. Other variations will include any and all other types of materials which would be appropriate for enhancing the effectiveness of the image on the self-standing display device.

In other variations regarding use of the device as retail merchandise the Binding Attachment Panel, which is labeled "1" in FIGS. 1 thru 6, 8 thru 14 and 16, may be used to function as a self-contained packaging display header card. In this case this panel may be decorated with appropriate marketing graphics and text and may incorporate holes, hooks or other design elements which would be necessary and appropriate to allow it to be used to attach to, or hang from, a retail display case, shelf or hook.

In the version of the Display Device in which the Printed Page does not include the attachment of a separately printed image, the display image is printed directly on the Front Display Panel. In the variation with the attached, separately printed image, appropriate glue or other binding material is used to affix the image to the printed page.

The production of the Display Device is accomplished through standard print production processes commonly used for printing on paper or plastic and further involves finishing with the application of certain specific perforation and score lines and/or specific shape dye cutting which are also common print production processes. The Display Device may also have a separately printed image which is attached to the front display panel using common production processes. The final elements of production may involve insert binding in publications or inserting as a free-standing unit in publications or into retail packaging. The two primary areas in which the invention is expected to be used are the advertising and promotion industry and the retail marketplace. In advertising, the Display Device is placed in a print advertising medium such as a magazine, newspaper or direct mailer. Because the Display Device varies in content and format from the rest of the advertisements in the medium, it immediately grabs the attention of the viewer. The Display Device is either bound into the printed medium, placed in as a free standing insert or is otherwise a part of the medium, such as in the case of a Direct Mailer.

Once the Display Device has captured the attention of the viewer, the viewer removes it from the publication or mailer and creates the self-standing display for long term viewing. In the retail area, the self-standing display device may be sold as a retail product and the consumer removes it from the packaging and creates the self-standing display for long term viewing. The self-standing display is created in the following manner: A.) In the case of the standard version with side panel support, the detachable portion is detached along the detachment perforation line, the side support panel(s) is folded back from the front display panel along the score line(s) and has a straight bottom edge which creates a stationery self-standing display. B.) In the case of the standard version with A-Frame support, the detachable portion is detached along the perforation line, the rear panel is folded back and behind the front display panel, the two bottom panels are folded under the front and rear panels and mated through joining matching cut lines to form a flat bottom panel which creates a stationery self-standing display. C.) In the case of the rear-easel version, the detachable easel portion is detached along the perforation line and the easel panel is folded back from the front display attachment panel along the score line and has a straight bottom edge which creates a stationery self-standing display. D.) In the case of the rocker version, the detachable portion is detached along the perforation line, the side support panels are folded back from the front display panel along the score lines and have a curved bottom edge which creates a rocking self-standing display for optimizing the presentation of animated or other special effects images. E.) In the case of the rocker version which is pre-cut and not detached from another portion, the side support panels are folded back from the front display panel along the score lines and have a curved bottom edge which creates a rocking self-standing display. F.) In the case of the rocker version with the top-support crossbar, which version may be detachable or pre-cut, the support and rocking display structure is created as described previously with the addition of the mating of the top support crossbar to the side support panels through the joining of the slits provided in the bottom of the top support crossbar and the top of the support panel. G.) In the case of the rocker version with separate side support panels, which version may be detachable or pre-cut, side support panels are place in a perpendicular orientation to the front display panel and the front display panel is inserted into the slits provided on the side support panels which creates a rocking self-standing display.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An advertisement insert for a bound printed publication, said advertising insert comprising:

a page insert that is bound as a page into the printed publication, said page insert including a perforated detachment line that divides said page insert into a binding attachment portion and a detachable portion, said perforated detachment line enabling said detachable portion to be selective separated from said binding attachment portion, wherein said binding attachment portion remains bound to said bound printed publication;

said detachable portion having fold lines that enable said detachable position to be folded into a free-standing three dimensional display having a flat face panel and curved base edges that enable said free-standing three dimensional display to rock; and a lenticular printing disposed on at least one section of said flat face panel, wherein said lenticular printing presents an image that varies upon a viewer's angle of observation.

2. The advertisement insert according to claim 1, wherein said free-standing three dimensional display supports said lenticular printing at an inclined angle that varies as said free-standing three dimensional display rocks.

3. The advertisement insert according to claim 1, wherein said lenticular printing is printed directly only said flat face panel.

4. The advertisement insert according to claim 1, wherein said lenticular printing is adhesively affixed to said flat face panel.

5. An advertisement insert for a bound printed publication, said advertising insert comprising:

a page insert that is bound as a page into the printed publication, said page insert including a perforated detachment line that divides said page insert into a binding attachment portion and a detachable portion, said perforated detachment line enabling said detachable portion to be selective separated from said binding attachment portion, wherein said binding attachment portion remains bound to said bound printed publication;

said detachable portion having fold lines that enable said detachable position to be folded into a free-standing three dimensional display that includes:

a flat face panel having a first side edge and an opposite second side edge;

a first side panel extending from said first side edge of said flat face panel, said first side panel having a first curved bottom edge;

a second side panel extending from said second side edge of said flat face panel, said second side panel having a second curved bottom edge;

wherein said first side panel and said second side support said flat face panel at an inclined angle that varies as said first side panel and said second side panel rock upon said first curved bottom edge and said second curved bottom edge, respectively; and a lenticular printing disposed on at least one section of said flat face panel, wherein said lenticular printing presents an image that varies upon a viewer's angle of observation.

6. The display according to claim 5, wherein said flat face panel, said first side panel and said second side panel are formed from a single folded panel.

7. The display according to claim 5, wherein said lenticular image is printed upon said flat face panel.

8. The display according to claim 5, wherein said lenticular image is adhesively bonded to said flat face panel.

* * * * *